US007993024B2

(12) United States Patent
Migli

(10) Patent No.: US 7,993,024 B2
(45) Date of Patent: Aug. 9, 2011

(54) QUICK-FITTING DEVICE FOR INTERNAL LIGHTING OF FURNITURE

(75) Inventor: Carlo Migli, Lecco (IT)

(73) Assignee: Agostino Ferrari S.p.A., Bergamo BG (IT)

( * ) Notice: Subject to any disclaimer, the term of this patent is extended or adjusted under 35 U.S.C. 154(b) by 429 days.

(21) Appl. No.: 12/292,835

(22) Filed: Nov. 26, 2008

(65) Prior Publication Data

US 2009/0141483 A1 Jun. 4, 2009

(30) Foreign Application Priority Data

Dec. 3, 2007 (IT) ..... MI2007A2263

(51) Int. Cl.
*A47B 23/06* (2006.01)

(52) U.S. Cl. ..... 362/133

(58) Field of Classification Search ..... 362/127, 362/133

See application file for complete search history.

(56) References Cited

U.S. PATENT DOCUMENTS 5,032,957 A * 7/1991 Canfield ..... 362/133
5,580,155 A * 12/1996 Hildebrand et al. ..... 362/133
7,384,166 B2 * 6/2008 Tress et al. ..... 362/133

* cited by examiner

*Primary Examiner* — Jason Moon Han
*Assistant Examiner* — Sean P Gramling
(74) *Attorney, Agent, or Firm* — Jacobson Holman PLLC

(57) ABSTRACT

A device for automatic battery-operated lighting of the inside of a piece of furniture comprises a body provided with fixing means on a surface of the furniture by means of a mounting surface thereof and a chamber containing an electric battery and a light source and from which the control end of a normally closed pushbutton contact protrudes frontally for the connection of the battery to the light source when the furniture is opened. The fixing means comprises a tongue, intended for resting at a corner of the surface of the furniture and a tooth facing the tongue that is intended to be inserted into a hole on set surface of the furniture. A hooking lever is rotatable on the base body from an unhooking position to a hooking position, controlling the movement of means for moving the tooth towards the tongue to cause the tooth to engage in the wall of the hole with a reaction on the tongue resting on the corner of the furniture.

19 Claims, 3 Drawing Sheets

QUICK-FITTING DEVICE FOR INTERNAL LIGHTING OF FURNITURE

BACKGROUND OF THE INVENTION

1. Field of the Invention

This invention refers to a device for internal lighting of furniture.

2. State of the Prior Art

In the prior art small battery devices are known that can be arranged inside a piece of furniture, generally a cupboard, to light the inside thereof. Some of these devices have a power pushbutton arranged so as to switch off the device automatically when the piece of furniture is closed. There is a need to provide these devices with a system of fixing to the piece of furniture that is rapid and repositionable but the solutions proposed in the prior art are unsatisfactory.

For example, removing a screw and/or expansion plug-mounted device exposes the original hole with the spoilt edges to view. It not only becomes difficult to ensure a future solid fixing in the hole, but the aesthetic appeal is in any case compromised, as the ruined hole clearly stands out inside the piece of furniture. Further, in the case of expanding plugs, the plug that is removed is normally deformed and hardly reusable.

A further added feature is that of having stable and tough hooking, above all because the lighting device receives quite heavy and repeated blows on the power pushbutton. However, this conflicts with the desire for a rapid, simple system that does not spoil the point of hooking and is flexible without the use of tools.

Further, it is desired that the entire device should be small, with a simple, tough and cheap structure and enables the battery to be changed easily. Also in this, the known solutions are unsatisfactory.

The general object of the present invention is to provide a lighting device for furniture that has a simple, tough and cheap structure and which is rapidly and securely fixable without the use of tools. A further object is for the device to enable the battery to be changed easily.

SUMMARY OF THE INVENTION

In view of this object it was decided to make, according to the invention, a device for the automatic battery-operated illumination inside a piece of furniture, comprising a body provided with fixing means on a surface of the piece of furniture by means of a mounting surface thereof and a chamber containing an electric battery and a light source and from which at the front the control end of a normally closed pushbutton contact protrudes to connect the battery to the light source to the opening of the piece of furniture, characterized in that the fixing means comprises a tongue, which is intended to rest at a corner of the surface of the furniture and a tooth that faces the tongue and is intended to be inserted into a hole on said surface of the furniture, a hooking lever being rotatable on the base body from an unhooking position to a hooking position controlling means for moving tooth and tongue towards one another to cause the tooth to engage in the hole wall with a reaction on the tongue resting on the corner of the piece of furniture.

BRIEF DESCRIPTION OF THE DRAWINGS

In order to make clearer the innovative principles of the present invention and the advantages thereof over the known prior art, a possible embodiment applying such principles will be disclosed below with the help of the attached drawings by way of non-limiting example. In the drawings.

DETAILED DESCRIPTION OF THE INVENTION

Figure 1:
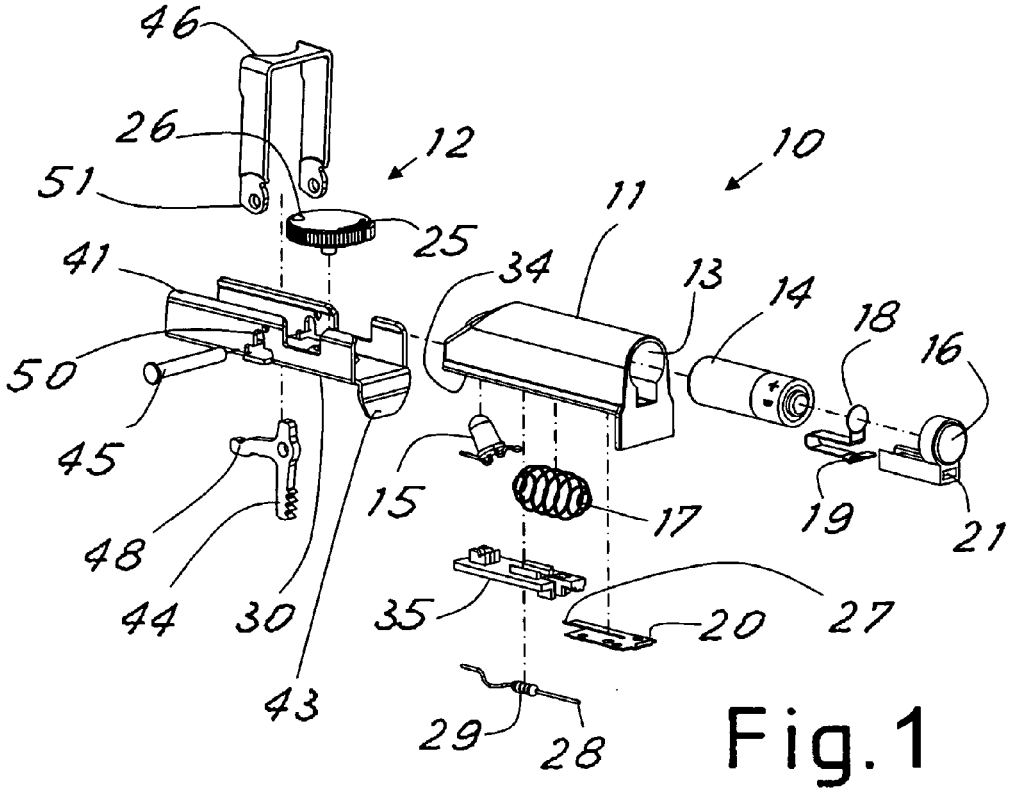
FIG. 1 is an exploded perspective view of a lighting device made according to the principles of the invention.

With reference to the figures, in FIG. 1 there is shown the exploded view of a device according to the invention, generally indicated by 10.

The device 10 comprises a body 11 (advantageously molded from plastics) provided with fixing means 12 for fixing to the furniture and with a chamber 13 containing an electric battery 14. In the body there is also a light source 15 (advantageously a high-luminosity white LED) that protrudes externally to project a light beam. From a front end of the body there protrudes the control end or pushbutton 16 of a normally closed pushbutton contact for connecting the battery to the light source when the furniture is opened.

The fixing means 12 comprises a base body 41, which is preferably made of metal and which defines a mounting surface 30 intended to rest on the fixing wall on the piece of furniture. Advantageously, the base body 41 can be made of U-shaped sheet metal to make a pair of side rails 58 extending parallel to the main axis of the base to enable the body 11 to be received as in a drawer manner.

From the surface 30 there protrude an abutting tongue 43 and an engaging tooth 44, that face one another and are generally parallel. The tooth 44 is supported on the body by means of a pivot 45 and is moved between a rest position and an engaging position by activating an operating lever 46. Advantageously, the tooth 44 has an edge facing the tongue 43 that is deeply serrated. Means for moving the tooth and tongue towards one another are controlled by the lever 46. As can be clearly seen also in FIG. 2, in the shown embodiment the tooth 44 protrudes from the surface 30 through a groove on the bottom of the body 41 and, inside the base, it is connected to the lever 46 by means of the pivot 45. The tooth is free to rotate in relation to the pivot and has a square arm 48 that protrudes parallel to the surface 30 and in the direction opposite the tongue 43. The end of the arm 48 is connected to be able to slide towards and away from the tongue 43 with the possibility of slight rotation but without moving away from the mounting surface 30. For this purpose, the end of the arm 48 rests under a surface 49, advantageously obtained as monoblock in the base.

The pivot 45 is constrained to slide transversely to the axis thereof along guide grooves 50 in the base in a normal direction to the mounting surface 30.

Figure 4:
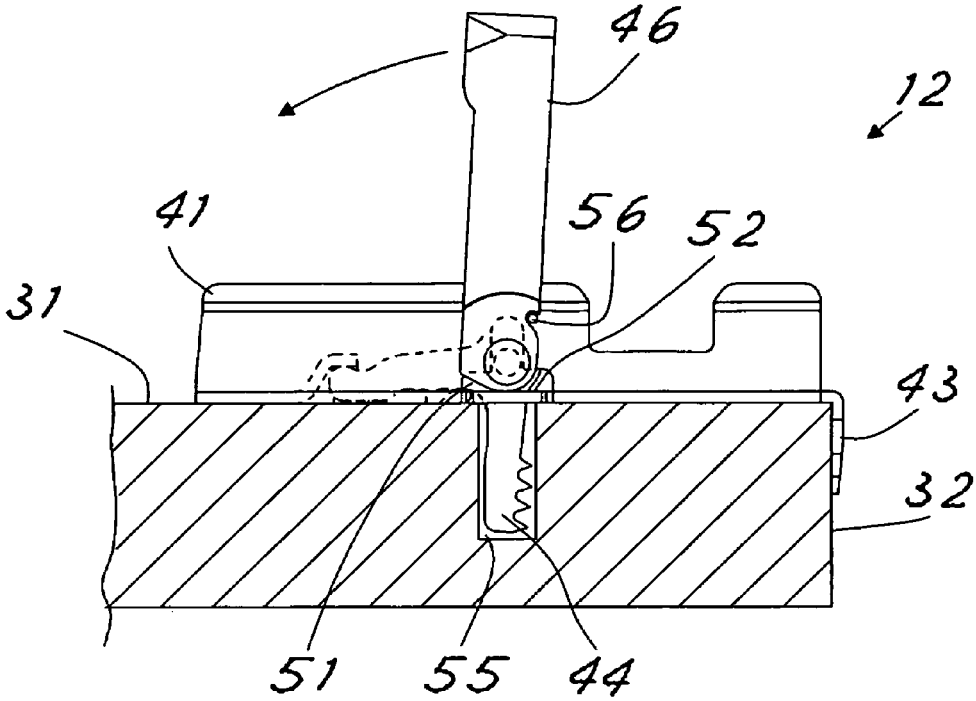
FIGS. 4 and 5 are lateral views of the part of the base of FIG. 1 positioned on a piece of furniture, before and after engagement.
Figure 5:
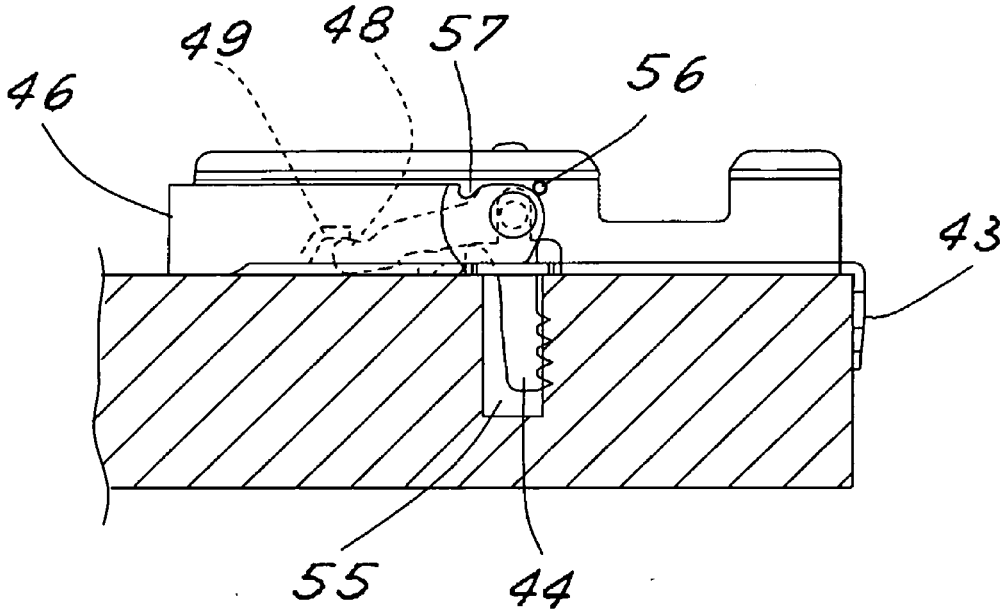

The lever 46, which is advantageously U-shaped, is mounted at the ends of the pivot to rotate from the unhooking position of FIG. 4 (advantageously raised normal to the mounting surface) to the hooking position of FIG. 5 (advantageously lowered parallel to the mounting surface and in a direction behind the base). Each pivoted end of the lever defines a cam 51 that works against a surface 52 on the base. The two surfaces 52 are advantageously formed by flaps protruding laterally from the body 41.

As can be clearly seen from the comparison with FIGS. 4 and 5, the cams 51 are shaped eccentrically to the pivot 45 to cause the pivot to slide along the grooves 50 to the movement of the lever between the raised position of FIG. 4 and the lowered position of FIG. 5. The movement of the pivot (upwards in FIGS. 4 and 5) combined with the support of the end of the square arm 48 against the surface 49 causes the tooth 44 to rotate towards the tongue 43, advantageously combined with a retraction movement of the tooth 44 into the surface 30.

From the drawings it is clear how the opposition movement between the tooth 44, driven by the lever 46, and the tongue 43 enable the device to be firmly fixed to the surface 31 of a piece of furniture near a corner 32 and exploiting a hole 55.

The positioning of the tooth 44 on the base is sized so that when the lever 46 starts operation, moving to the engaging position (FIG. 5), the distance between the tongue 43 and the serrated edge of the tooth is less than the distance between the hole and the front edge of the side of the piece of furniture.

In this manner, driving the lever 46 involves moving the tooth until the tooth interferes with the wall of the hole 25, reacting with the tongue 43. The retracting movement of the tooth (upwards in FIG. 5) simultaneously contributes to making the base adhere to the surface of the piece of furniture, making fixing solid and free of clearance even in the event of strong and repeated shocks in the thrust direction of the switching-off pushbutton.

In order to unhook the device from the piece of furniture it will be sufficient to return the lever to the initial position, freeing the tooth 44. Advantageously, when the lever is raised to the rest position suitable locking means prevent sliding of the pivot due to the traction on the lever. This is advantageously obtained with lateral protrusions 56 on the base body that are housed in corresponding grooves 57 in the ends of the lever, preventing upward traction on the lever taking the tooth 14 to the clamping position without rotating the lever. This also enables the lever to be used as a handle to remove the device.

Advantageously, the grooves 57 have an inlet for the protrusions 56 that is shaped for actively pushing the pivot 45 into the start position and ensuring the return movement of the tooth 44 to the rest position. As can be seen clearly in FIG. 5, the protrusions 56 can also be positioned so as to slide on the surface of the cam of the lever for the entire movement of the lever between the hooking position and the rest position, so that the movement of the pivot is firmly guided in both directions along the grooves 50.

Figure 2:
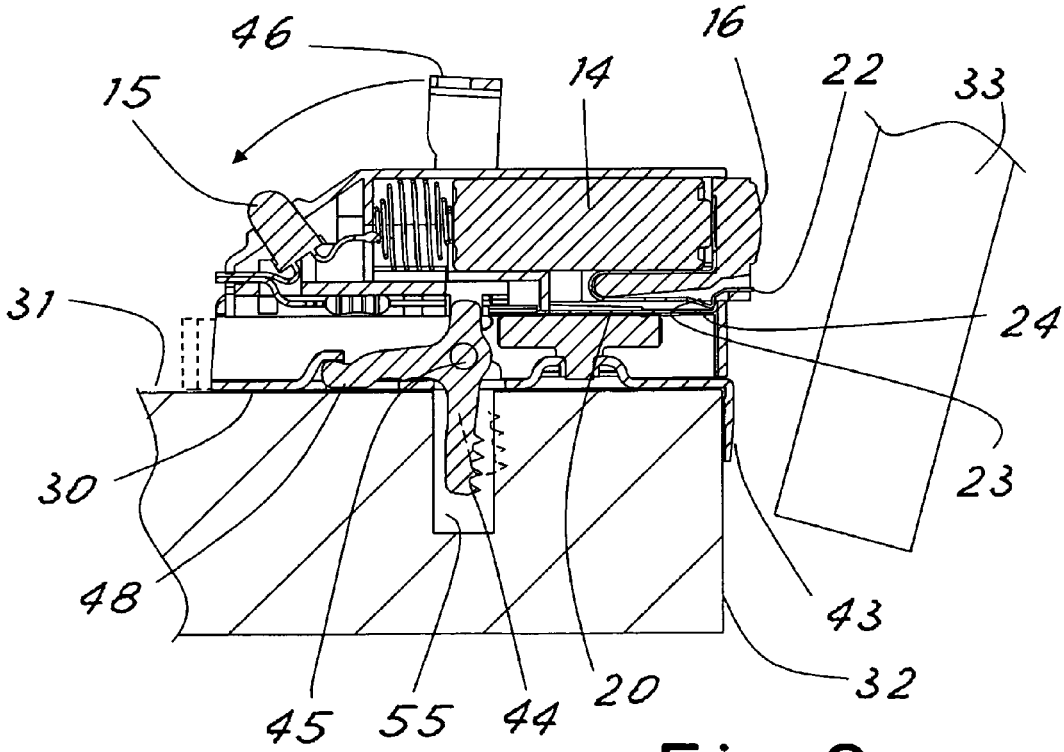
FIG. 2 is a sectional side view of the device in FIG. 1 mounted on a piece of furniture.

As can be seen clearly in FIG. 2, the device 10 is intended for being positioned near the edge 32 of the surface 31 of the piece of furniture that is an abutment for the element 33 of the piece of furniture (for example, a slidable front or a hinged door, generally shown semi-open in FIG. 2) that closes the space of the piece of furniture that it is desired to light so that the pushbutton 16 is pressed by the element 33 in a closed position and is released when the element 33 is opened.

In FIGS. 1 and 2 the advantageous internal embodiment of the device is seen. In this embodiment the chamber for receiving the battery (of pen type) extends advantageously according to the main axis of the device, i.e. the axis coinciding with the thrust direction on the on/off control end 16. At the bottom of the chamber 13 there is a contact spring with a battery pole whilst the opposite end of the chamber, which is the axial insertion end of the battery, is closed by the control end 16, which is slidable mounted on the open end of the chamber and which constitutes the cover or cap of the battery chamber at the other battery pole. The chamber is generally cylindrical, to accommodate the pen battery with minimum clearance, like the pushbutton 16. The control end 16 supports a contact blade 18 inside the chamber intended for resting on the facing battery pole. The blade extends to form a contact tongue 19 that normally rests on a second contact blade 20 supported in the body 11 and which constitutes the fixed contact of the pushbutton switch. The rest between the tongue 19 and the blade 20 is such that the electric contact between the tongue 19 and the blade 20 is interrupted when the pushbutton 16 is pushed inside the chamber 13 against the action of the spring 17. The tongue 19 is advantageously received in a box-shaped protrusion on a side of the pushbutton 16.

Also advantageously, the tongue 19 also constitutes a removable fixing means for maintaining the pushbutton 16 fixed in the seat 13 during normal operation of the device. For this purpose, the tongue 19 has a bent end that protrudes frontally on the pushbutton 16 in a suitable seat 21 to constitute an end 22 for the manual control for unhooking a tooth 23 of the tongue from an abutment 24. The abutment 24 can advantageously coincide with an end of the fixed contact 20. The tooth 23 advantageously has a tilted surface for elastically flexing the tongue 19 when the pushbutton 16 is inserted into the seat and for then snapping into the lock position against the abutment 24.

Figure 3:
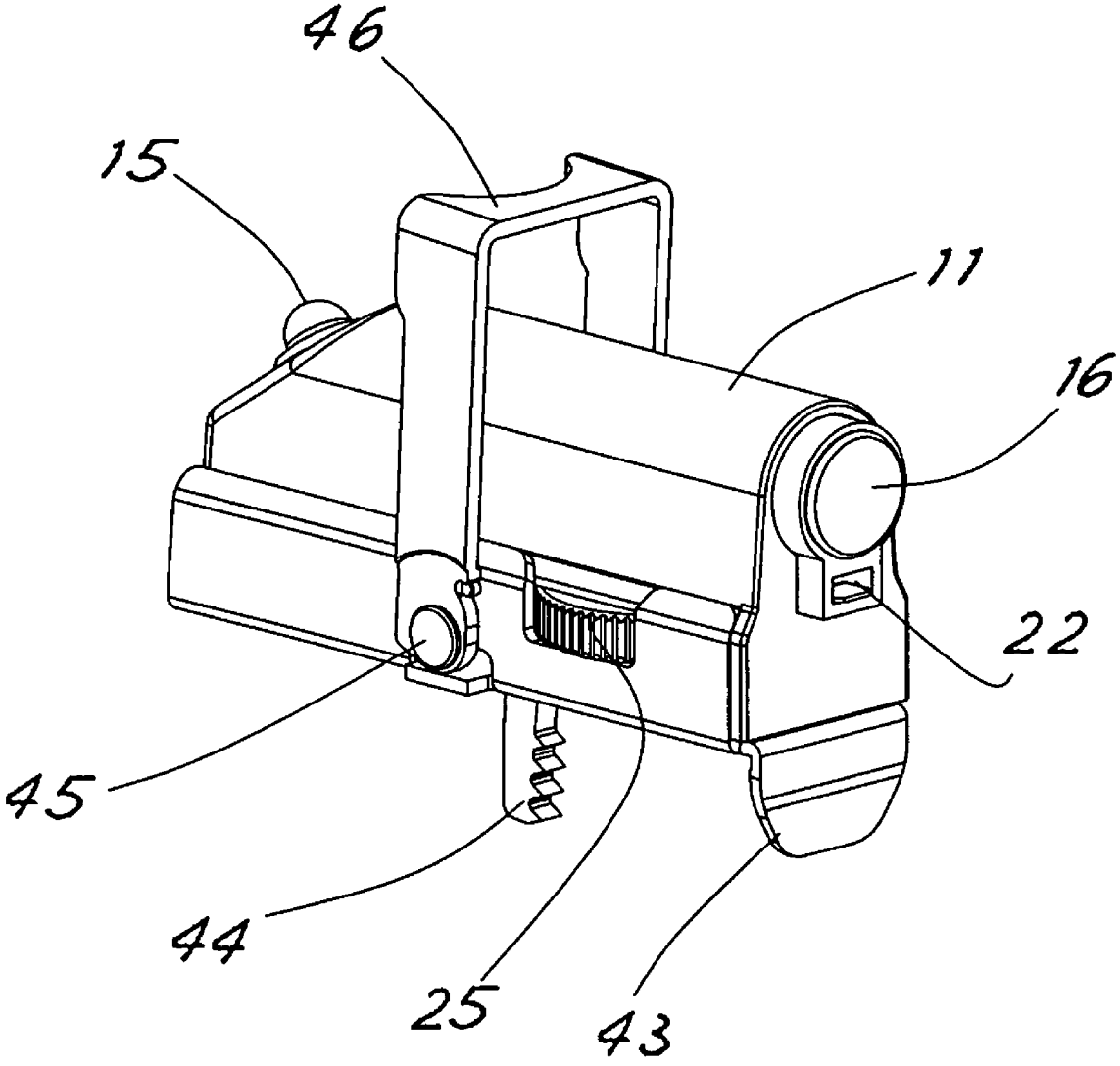
FIG. 3 is a perspective view of the assembled device in FIG. 1.

Advantageously, the fixed contact 20 is connected to the lighting source by interposing an overriding switch arranged serially on the circuit to enable the lighting to be switched off even when the pushbutton 16 is not pressed. In the shown embodiment, the overriding switch comprises a control wheel 25, pivoted in the device and protruding laterally therefrom (as can be seen clearly in FIG. 3) to be manually rotatable. The control wheel has a protrusion 26 (FIG. 1) that, depending on the angular position of the wheel, pushes or does not push an end 27 of the contact blade 20 to move the contact blade 20 and open the circuit that it forms to the lighting source or to close the circuit. Advantageously, the end 27 normally rests on a conductor 28 of a resistor 29 limiting the supply current of the LED, sparing the use of a further contact blade.

The lighting source is advantageously at the rear end of the body 11, i.e. the end opposite the pushbutton 16, and is tilted with respect to the axis movement of the pushbutton and directed away from the fixing surface. In this manner it appropriately illuminates the interior of the piece of furniture.

Advantageously, assembling the various parts of the device inside the body 11 occurs through a lower opening 34 of this body that is closed by a plate 35 made of plastics that is snap-inserted.

At this point it is clear how the preset objects have been reached. Engaging is rapid and fixing is of excellent solidity. The presence of the reaction tongue on the edge of the surface of the piece of furniture makes fixing substantially insensitive to thrust forces directed towards the interior of the piece of furniture, such as those that act on the device upon closure of the piece of furniture. Further, the gripping movement inside the hole ensures that the edge of the hole remains undamaged. The device can thus be removed without leaving a trace and can be repositioned as many times as is desired. The device can be dimensioned so as to adapt to a standard system for drilling the sides, like the 37×32 and 28×32 systems that are used by most furniture manufacturers for fixing accessories. In this manner special drilling is not necessary.

By providing an abutting surface consisting of the tongue 43 that rests on the outside of the front edge of the piece of furniture, the tolerances of the drilling and fixing system are made insignificant and positioning is more accurate. This is very advantageous to have correct interaction between the pushbutton and part of the piece of furniture that closes by abutting on the outer edge of the side. Further, replacing the battery is easy and the cost of the device is limited despite the toughness and reliability thereof.

Naturally, the above description of an embodiment applying the innovative principles of the present invention is given by way of example of such innovative principles and must not therefore be taken to limit the scope of what is claimed herein.

For example, as easily imaginable by those skilled in the art, the form of the fixing base may vary and can also be made integral with the body 11. The base can be made of bent sheet metal, as shown, or can be made molded or in another manner. Also the shape and arrangement of the operating lever can be different from those shown. Although the lever movement disclosed has been found to be particularly advantageous in terms of toughness, practicality and cost, other operating means for moving the tooth can easily be imagined by those skilled in the art in the light of the above description, to control the moving of the tooth towards the tongue 13 and, possibly, to pull the tooth inside the resting surface of the base. Naturally, as easily imaginable by those skilled in the art, the resting surface 12 can be made for only partial resting with the piece of furniture (for example by means of feet or raised edges). The tooth can also have an engaging edge in the wall of the hole that works by friction rather than biting the material. In such a case the tooth can be made covered with yieldable material with good friction (for example rubber or the like). The overriding switch can also be made with a different operation, for example as a slidable slide.

What is claimed is:

1. A device for battery-operated automatic lighting of the interior of a piece of furniture, comprising a body provided with fixing means for fixing on a surface of the piece of furniture by a mounting surface thereof, and said body including chamber containing an electric battery and a light source and from which there frontally protrudes the control end of a normally closed pushbutton contact for connecting the battery to the light source with the opening of the piece of furniture, the fixing means including a base body having a tongue intended for resting at a corner of the surface of the piece of furniture and a tooth that faces the tongue and is intended to be inserted into a hole on said surface of the piece of furniture, a hooking lever being rotatable on the base body from an unhooking position to a hooking position for moving the tooth towards the tongue to cause the tooth to engage against a wall of the hole with the tongue resting on the corner of the piece of furniture.

2. The device according to claim 1, wherein the movement of the tooth and tongue towards one another occurs by tilting of the tooth in relation to the tongue.

3. The device according to claim 1, wherein the movement of the tooth and tongue towards one another is combined with retracting movement of the tooth into the mounting surface.

4. The device according to claim 3, wherein the moving towards means comprises a pivot with an axis that is transverse to said moving towards direction and supports the tooth, and sliding cam means of the pivot in a direction that is substantially normal to the mounting surface and is kinematically connected to the hooking lever for the operation thereof, the tooth comprising a square arm that has a fixed end so as to make the tooth tilt around the pivot at said sliding of the pivot.

5. The device according to claim 4, wherein the lever is U-shaped with the ends of the two arms of the U that are pivoted on the pivot on two sides of the tooth and the cam means comprises two cam surfaces that are made on the two pivoted ends of the lever.

6. The device according to claim 4, wherein the pivot is guided at the ends by two guide grooves.

7. The device according to claim 5, wherein the pivot is guided at the ends by two guide grooves and the pivot protrudes from the body through the guide grooves to support the two pivoted ends of the lever.

8. The device according to claim 1, wherein in the unhooking position the lever is raised in a direction substantially normal to the mounting surface, whilst in the hooking position it is lowered substantially parallel to the mounting surface.

9. The device according to claim 4, wherein in the unhooking position the lever engages locking means that prevents sliding of the pivot owing to traction on the lever in the direction of extraction of the tooth from the hole.

10. The device according to claim 1, wherein the tooth has an edge facing the tongue that is serrated to bite the wall of the hole.

11. The device according to claim 1, wherein the control end also constitutes the cover of the battery chamber at a battery pole.

12. The device according to claim 11, wherein the control end supports a contact blade for the battery pole, the blade extending in a tongue that constitutes the pushbutton electric contact that disconnects the electric circuit between the battery and lighting source when the control end is pushed inside the battery chamber.

13. The device according to claim 11, wherein the chamber contains a spring on the bottom at the other pole of the battery to constitute an electric contact with the other pole and enable slidable movement towards the inside of the pushbutton together with the battery against the action of the spring.

14. The device according to claim 12, wherein the tongue that extends from the contact blade with the battery also constitutes an engaging means that is releasable from outside to remove the cover in the form of said control end, closing the battery chamber.

15. The device according to claim 11, wherein it comprises un overriding serial manual switch on the supply circuit between the battery and the lighting source.

16. The device according to claim 15, wherein the overriding switch is constituted by a wheel the rotation of which controls a respective connecting or disconnecting movement of a part of a serial electric contact on the circuit.

17. The device according to claim 15, wherein the overriding switch is constituted by a slide cursor arranged transversely to the main axis of the device to be manually moved to protrude from one or another side of the body and to control respective movement of a serial electric contact on the circuit.

18. The device according to claim 11, wherein the lighting source is a LED.

19. The device according to claim 11, wherein the lighting source is directed to the rear of the device and is tilted in relation to the main axis of the device in a direction opposite a mounting surface of the device on the piece of furniture.

* * * * *